United States Patent [19]

Hoereth et al.

[11] Patent Number: 4,798,249

[45] Date of Patent: Jan. 17, 1989

[54] LOCKABLE STRIKING MECHANISM FOR HAMMER DRILL

[75] Inventors: Hans-Jürgen Hoereth, Langenbach; Anton Neumaier, Fürstenfeldbruck, both of Fed. Rep. of Germany

[73] Assignee: Hilti Aktiengesellschaft

[21] Appl. No.: 105,084

[22] Filed: Oct. 5, 1987

[30] Foreign Application Priority Data

Oct. 3, 1986 [DE] Fed. Rep. of Germany ..... 3633675

[51] Int. Cl.[4] ..... B25D 17/06

[52] U.S. Cl. ..... 173/14; 173/116

[58] Field of Search ..... 173/13, 116, 109, 14; 279/75, 19.4, 19.5

[56] References Cited

U.S. PATENT DOCUMENTS 3,841,418 10/1974 Biersack ..... 173/109

4,284,148 8/1981 Wanner et al. ..... 173/109

4,442,906 4/1984 Simpson ..... 173/48

*Primary Examiner*—Frank T. Yost

*Assistant Examiner*—James L. Wolf

*Attorney, Agent, or Firm*—Toren, McGeady & Associates

[57] ABSTRACT

In a hammer drill, a striking mechanism supplied percussive force to a tool. The striking mechanism includes a free piston slidably displaceable in a reciprocating manner within a guide cylinder. Balls mounted in the guide cylinder are spring biased into a recess in the free piston for securing the piston in a locked position so that it cannot deliver percussive force to the tool. The balls are spring biased by a ring encircling the cylinder with a spring pressing the ring in the axial direction of the cylinder against the balls.

4 Claims, 2 Drawing Sheets

LOCKABLE STRIKING MECHANISM FOR HAMMER DRILL

BACKGROUND OF THE INVENTION

The present invention is directed to a hammer drill with a striking mechanism including a free piston slidably displaceable in a reciprocating manner within a guide cylinder for transmitting blows to a tool mounted in one end of the cylinder. Balls mounted in the guide cylinder are spring biased radially inwardly into a recess in the free piston for retaining the piston in a locked position incapable of delivering blows to the tool.

In known hammer drill, striking mechanisms are used to direct blows or percussive force against a tool so that the tool can carry out its intended purpose. So-called pneumatic striking mechanisms have been found to be particularly effective and such mechanisms employ a free piston which can be provided with reciprocating motion by a drive piston by varying the pressure of the drive piston acting on the free piston. As the drive piston reciprocates, it moves the free piston in a similar manner so that the free piston moves back and forth and transmits blows or percussive force to a tool mounted in the hammer drill. It is important in such hammer drills to prevent the transmission of blows to the tool when it is not being used by securing the free piston in a locked position while the drive piston continues to reciprocate, particularly to conserve the tool when not in use.

To secure the free piston in the locked position, it is displaceable toward the tool beyond the working stroke where blows are applied to the tool in a hammer drill, such as disclosed in DE-PS No. 2 806 611. When the free piston experiences this additional displacement movement, a circular recess in the piston moves into the effective range of balls displaced radially inwardly under spring action. The balls snap into a recess in the free piston and hold the piston in a locked position where it cannot transmit percussive force to the tool. To release the free piston from its locked position, it can be directly or indirectly displaced by the tool into a working position. For the inward movement of the balls, an elastic O-ring presses the balls radially inwardly. The balls and the O-ring are mounted in a guide annulus adjacent to the guide cylinder. Such an arrangement is disadvantageous especially due to the high percussive-like force applied to the O-ring when the free piston moves into the effective range of the balls which are displaced with a high velocity. This action leads to the fast wear of the O-ring. A further disadvantage of the known arrangement is that it precludes a radially compact construction, since the balls and the O-ring are located in a guide annulus and provision must be made for radial spring travel. Moreover, an O-ring has a highly progressive spring characteristic as well as a great scattering effect on the spring force.

SUMMARY OF THE INVENTION

The primary object of the present invention is to assure a long useful life for the spring means with a uniform spring force acting on balls in a hammer drill incorporating a free piston which can be held in a locked position by the balls.

In accordance with the present invention, the balls are displaceably supported in openings in the guide cylinder and are contacted by a spring-biased ring displaceable in the axial direction of the guide cylinder.

The spring biased ring presses each of the balls with the same force and moves them uniformly into the annular recess in the free piston when it reaches its locked position. The free piston can be pushed out of the locked position if the spring force is overcome, and the curvature of the balls in combination with the contour of the ring contacting them affords a displacement of the ring against the spring force. Accordingly, the balls can be moved out of the path of movement of the free piston.

The ring can be formed of a wear-resistant material. The spring is not subjected to direct radial force by the balls and, as a result, has a high useful life expectancy, especially when spring steel is used. Due to the arrangement of the balls in openings through the guide cylinder, a compact radial construction is possible, since the spring force acts axially on the ring and is redirected, by the configuration of the ring, radially against the balls.

The surface of the ring, serving as an abutment for the balls, is formed in a preferred manner as a conical surface. Such a surface affords an optimum transmission of the axial spring force to the balls with a relatively small axial force and, with the redirection of the force, higher radial forces act on the balls for their engagement with the recess in the free piston. The conical surface prevents any sharp-edged contact of the ring with the balls so that advantages are achieved with regard to operation and wear.

In a preferred arrangement, the conical surface widens in the direction toward the front end of the hammer drill, that is, toward the tool mounted in the front end of the drill. Such an arrangement is particularly advantageous if a short length of the device is desired. Preferably, a helical compression spring acts in combination with the conical surface, inclined to the axial direction of the drill, and the spring provides the force for moving the balls and biasing the ring toward the front end of the drill. A compression spring is a cost-effective component with an accurate force characteristic and a high useful life expectancy in the hammer drill of the present invention. The helical compression spring encircles the guide cylinder and at one end bears against the cylinder and at the other end bears against a shoulder on the ring facing away from the front end of the drill.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
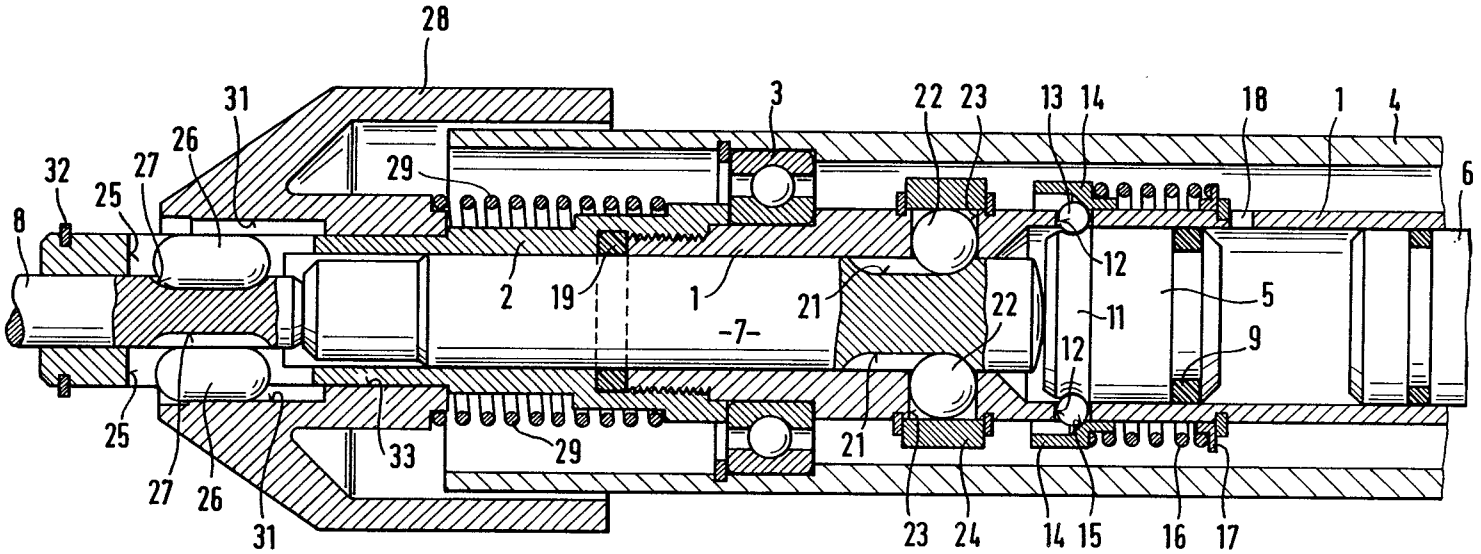
FIG. 1 is an extending sectional view of the front part of a drill with a tool inserted into the drill and wit striking mechanism secured in the locked position.

In the drawing, the front part of a hammer drill is shown in section, accordingly, the left-hand end of the various parts forming the hammer drill are designated as the front end and the right-hand ends are designated as the rear end. The hammer drill includes an axially extending guide cylinder 1 with a guide sleeve 2 threaded onto the front end of the cylinder and projecting axially from the cylinder. Guide cylinder 1 is rotatably supported in a hammer drill housing 4 by a ball-bearing 3 located near the front end of the cylinder. Guide cylinder 1 has an axially extending bore which has a larger diameter toward the rear end, that is, the right-hand part as viewed in FIG. 1, and a smaller diameter in the front part of the cylinder. A free piston 5 is located within the larger diameter part of the bore in the cylinder, in front of a drive piston 6 and the combination of the two pistons form a known pneumatic striking mechanism. The drive piston is driven in a reciprocating manner by a motor, not shown. An axially-elongated anvil 7 is located within the guide cylinder 1 and the guide sleeve 2. The rear end of the anvil is located immediately in front of the free piston 5 with the front end of the anvil located in the guide sleeve 2. For most of its axial length, the anvil 7 is located within the smaller diameter part of the bore in the guide cylinder 1 and then extends into the corresponding bore within the guide sleeve 2 Blows or percussive force are transmitted from the front end of the free piston 5 to the rear end of the anvil 7 and are then conveyed by the front end of the anvil to a tool 8, displaceably supported within the front part of the guide sleeve 2.

Adjacent its rear end, the free piston has a sealing ring 9 in sliding contact with the larger diameter part of the guide cylinder bore. At its front end, the free piston 5, has an annular recess 11. As shown in FIG. 1, balls 13 located in openings 12 extending radially through the guide cylinder 1, are seated within the recess 11 and hold the free piston 5 in a locked position, that is, it cannot move in a reciprocating manner within the bore under the action of the drive piston 6. A ring 14 encircles the guide cylinder 1 and presses the balls 13 into the recess 11. The ring 14 has a conical surface 15 forming a part of its inside surface and the conical surface bears against the balls 13. The conical surface faces toward the front end of the hammer drill. A helical compression spring 16 encircles the guide cylinder 1 and its rear end abuts against a backup disc 17, seated in the guide cylinder 1, and its front end bears against and biases the ring 14 in the direction toward the front end of the hammer drill. Balls 13 in combination with the ring 14 and the compression ring 16 form a locking device for the free piston 5. In the locked position of the free piston 5, shown in FIG. 1, a vent opening 18 is located through the guide cylinder rearwardly of the rear end of the free piston. In the locked position, the free piston 5 does not cover or block the vent opening 18, so that any reciprocating movement of the drive piston does not develop a varying pressure condition in the guide cylinder 1 causing the free piston to reciprocate following the movement of the drive piston. Anvil 7 is displaceably supported in a sealed manner by a sealing ring 19, located between the guide cylinder 1 and the guide sleeve 2, and contacting a middle portion of the anvil. Adjacent its rear end, the anvil 7 has axially extending grooves 21, formed in its outer surface with balls 22 movably supported in the grooves so that the anvil can be moved in the axial direction over the range of the grooves. Balls 22 are supported within openings 23 extending radially through the guide cylinder 1 and the balls are held within the grooves by a retaining ring 24 encircling the guide cylinder.

In the front region of the guide sleeve 2, two diametrically opposite windows or apertures 25 extend through the guide sleeve and a roller shaped locking member 26 is located within each of the apertures so that the locking member can move both axially and radially. Locking members 26 serve to lock the tool 8 for rotational movement while permitting axial movement. The locking members 26 can be displaced radially inwardly into axially elongated entrainment recesses 27 in the tool 8.

A positioning sleeve 28 encircles the guide sleeve 2 and at its rear end is located around the front end of the housing 4. The positioning sleeve 28 is biased toward the front end of the hammer drill by a compression spring 29. The positioning sleeve 28 is arranged to move the locking members 26 radially inwardly into engagement with the recesses 27 in the surface of the tool 8. In FIG. 1, a tool is inserted into the front end of the guide sleeve 2 and the positioning sleeve 28 is pressed rearwardly against the compression spring 29 so that it is in a release position whereby the locking members 26 are not secured within the recesses 27. In the release position, the positioning sleeve 28 has pocket-shaped recesses 31, located opposite the locking members 26, so that the locking members are free to move radially outwardly for the insertion or removal of the tool 8.

Figure 2:
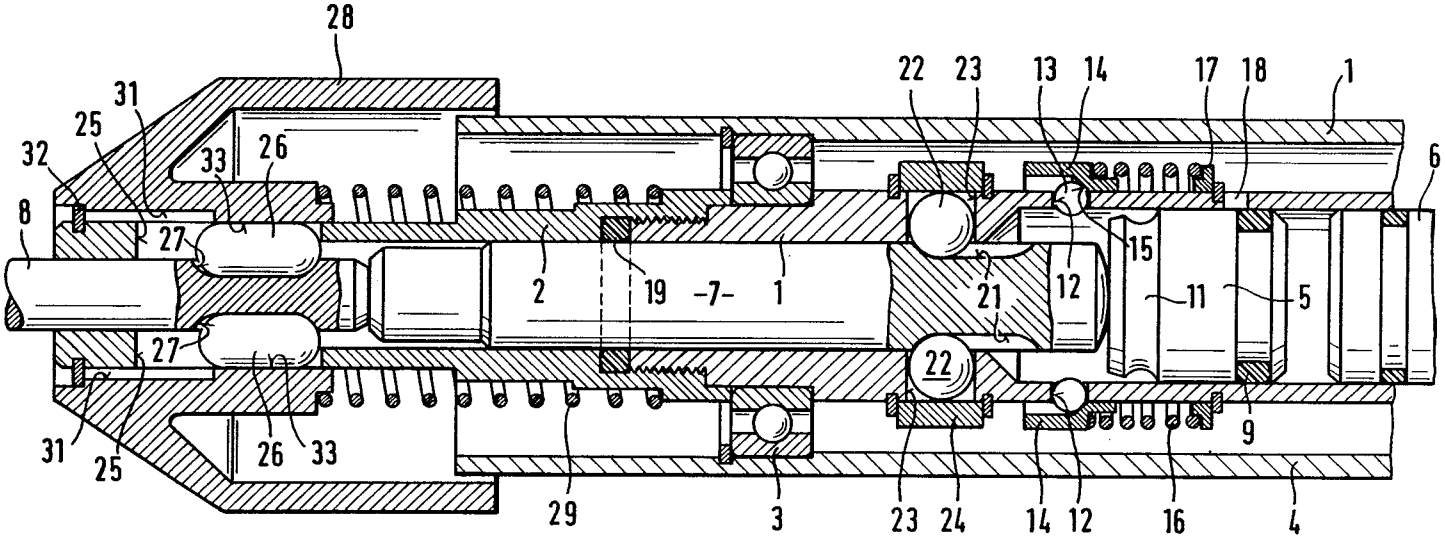
FIG. 2 is a view similar to FIG. 1, however, with the striking mechanism in the working position.

To lock the tool 8 in the guide sleeve 2, the positioning sleeve 28 is biased in the front end direction by the compression spring 29 and moves from the release, position shown in FIG. 1, into the locking position displaced in FIG. 2, with the recesses 31 moving out of the range of the locking members 26 and with the sleeve moving into contact with an abutment ring 32 seated in the outside surface of guide sleeve 2. Rearwardly of the recesses 31, the positioning sleeve 28, has an inner surface 33 which bears against the locking members 28 and presses them radially inwardly into the recesses 27 in the tool. In the locked position, the tool 8 can be pressed against a target material for performing its intended operation. As a result, the rear end of the tool 8 presses the anvil 7 in the rear end direction against the free piston 5. Accordingly, the free piston 5 is released from the locked position shown in FIG. 1 and reaches the working position illustrated in FIG. 2, whereby the free piston can be reciprocated within the guide cylinder 1, rearwardly of the region of the balls 13 pressed in the front end direction by the compression spring 16. In the working position, the free piston 5 blocks the vent opening 18 maintaining the air cushion located between the rear end of the free piston 5 and the front end of the drive piston 6. Accordingly, the drive piston moves in a reciprocating manner and a corresponding movement is transmitted over the air cushion to the free piston effecting the transmission of percussive force to the trailing end of the anvil. In turn, the anvil strikes against the rear end of the tool 8, so that the tool can perform its intended work.

While specific embodiments of the invention have been shown and described in detail to illustrate the application of the inventive principles, it will be understood that the invention may be embodied otherwise without departing from such principles.

We claim:

1. Hammer drill with a striking mechanism having a striking direction and a front end arranged to hold a tool, comprising a guide cylinder having an axis extending in the striking direction, said striking mechanism located within said guide cylinder for delivering percussive force in the striking direction to the tool, said striking mechanism includes a free piston slidably displaceable in a reciprocating manner within said guide cylinder in the striking direction, means for securing said free piston in a locked position so that said free piston is unable to perform reciprocating movements within said guide cylinder, said free piston having an axially extending outer surface, a recess formed in said outer surface, balls mounted in said guide cylinder, said securing means comprises spring means for biasing said balls inwardly into the recess for securing said free piston in the locked position, wherein the improvement comprises that said guide cylinder has openings therethrough with said balls each mounted in one of said openings, and said spring means comprises a ring encircling said guide cylinder and disposed in contact with said balls, and a spring in contact with said ring for pressing said ring against said balls and biasing said balls radially inwardly.

2. Hammer drill, as set forth in claim 1, wherein said ring has an annular surface in contact with said balls and said annular surface is conically shaped and encircles the axis of said guide cylinder.

3. Hammer drill, as set forth in claim 2, wherein said conical surface is located within an inner surface of said ring and diverges in the direction toward the front end of the hammer drill.

4. Hammer drill, as set forth in claim 3, wherein a helical compression spring laterally encircles said guide cylinder and abuts at one end against said guide cylinder and at the opposite end closer to the front end of the hammer drill against said ring for biasing said ring toward the front end whereby the conical surface of said ring converts the axial biasing action of said spring into a radial biasing action pressing said balls radially inwardly.

* * * * *